US010770019B2

(12) United States Patent
Ji

(10) Patent No.: US 10,770,019 B2
(45) Date of Patent: Sep. 8, 2020

(54) METHOD AND DEVICE FOR DRIVING DISPLAY PANEL WITH TWO PULSE SIGNALS FOR PRECHARGING PIXEL DRIVE CELLS

(71) Applicants: CHONGQING HKC OPTOELECTRONICS TECHNOLOGY CO., LTD., Chongqing (CN); HKC CORPORATION LIMITED, Shenzhen, Guangdong (CN)

(72) Inventor: Feilin Ji, Chongqing (CN)

(73) Assignees: CHONGQING HKC OPTOELECTRONICS CO., LTD., Chongqing (CN); HKC CORPORATION LIMITED, Shenzhen, Guangdong (CN)

( * ) Notice: Subject to any disclaimer, the term of this patent is extended or adjusted under 35 U.S.C. 154(b) by 0 days.

(21) Appl. No.: 16/311,396

(22) PCT Filed: Oct. 23, 2018

(86) PCT No.: PCT/CN2018/111485
§ 371 (c)(1),
(2) Date: Dec. 19, 2018

(87) PCT Pub. No.: WO2020/042310
PCT Pub. Date: Mar. 5, 2020

(65) Prior Publication Data

US 2020/0074950 A1 Mar. 5, 2020

(30) Foreign Application Priority Data

Aug. 31, 2018 (CN) ..... 2018 1 1013897

(51) Int. Cl.
*G09G 3/36* (2006.01)

(52) U.S. Cl.
CPC ..... *G09G 3/3677* (2013.01); *G09G 3/3614* (2013.01); *G09G 3/3648* (2013.01);
(Continued)

(58) Field of Classification Search
CPC .. G09G 3/3677; G09G 3/3614; G09G 3/3648; G09G 2310/08; G09G 2310/0251;
(Continued)

(56) References Cited

U.S. PATENT DOCUMENTS 9,774,846 B2 9/2017 Kim et al.
2011/0241526 A1* 10/2011 Huang ..... G09G 3/3648 313/307

(Continued)

FOREIGN PATENT DOCUMENTS

CN 101414089 A 4/2009
CN 102269904 A 12/2011
CN 102347013 A 2/2012

OTHER PUBLICATIONS

International Search Report, dated May 30, 2019, for Chongqing HKC Optoelectronics Technology Co., Ltd., et al., International Application No. PCT/CN2018/111485, Filed Oct. 23, 2018.

*Primary Examiner* — Darlene M Ritchie
(74) *Attorney, Agent, or Firm* — Westbridge IP LLC

(57) ABSTRACT

A method and a device for driving a display panel are provided by embodiments of the present application. The method includes: outputting an initial scanning signal including two pulse signals; pre-charging an x-th row of pixel drive cells when the x-th row of pixel drive cells receive a first pulse signal; and charging the x-th row of pixel drive cells when the x-th row of pixel drive cells receive a second pulse signal, writing data into the x-th row of pixel drive cells, and meanwhile, pre-charging an x+4m-th row of pixel drive cells.

17 Claims, 4 Drawing Sheets

(52) U.S. Cl.
CPC ..... *G09G 2300/0452* (2013.01); *G09G 2310/0205* (2013.01); *G09G 2310/0251* (2013.01); *G09G 2310/06* (2013.01); *G09G 2310/08* (2013.01)

(58) Field of Classification Search
CPC ..... G09G 2310/0205; G09G 2310/06; G09G 2300/0452
See application file for complete search history.

(56) References Cited

U.S. PATENT DOCUMENTS

| | | | | |
|---|---|---|---|---|
| 2011/0292012 | A1* | 12/2011 | Huang | G09G 3/3614 345/209 |
| 2014/0062984 | A1* | 3/2014 | Miyatake | G09G 3/3614 345/211 |
| 2014/0078125 | A1* | 3/2014 | Gondo | G09G 3/3614 345/209 |
| 2015/0116308 | A1* | 4/2015 | Wang | G09G 3/3677 345/214 |
| 2015/0356928 | A1* | 12/2015 | Xie | G09G 3/3225 345/694 |
| 2018/0308441 | A1* | 10/2018 | Feng | G09G 3/3648 |
| 2018/0314117 | A1* | 11/2018 | Huang | G11C 19/287 |

* cited by examiner

METHOD AND DEVICE FOR DRIVING DISPLAY PANEL WITH TWO PULSE SIGNALS FOR PRECHARGING PIXEL DRIVE CELLS

CROSS-REFERENCE TO RELATED APPLICATIONS

This application is the International Application No. PCT/CN2018/111485 for entry into US national phase with an international filing date of Oct. 23, 2018, designating US, now pending, and claims priority to Chinese Patent Application No. 201811013897.6, filed on Aug. 31, 2018, the content of which is incorporated herein by reference in its entirety.

BACKGROUND OF THE INVENTION

Field of the Invention

The present application relates to the technical filed of electronics, and more particularly to a method and a device for driving a display panel.

Description of Related Art

The liquid crystal panel includes pixel cells arranged in rows and columns. When the liquid crystal panel operates, a gate drive signal controls on and off state of a thin film transistor (TFT) in each pixel cell, thereby completing row scanning of the liquid crystal panel and realizing the image displaying function of the liquid crystal panel. Therefore, the liquid crystal panel is an important part of the display device. With the development of the display panel technology, the resolution of the display panel gradually increases, and the number of gate ICs required for the display panel increases. In order to reduce the cost, the Gate on Array (GOA) technology integrates the function of the gate IC into the glass panel of the display panel, so that the panel itself is able to control the on and off state of the thin film transistor without requiring the driving by the gate IC, thereby significantly reducing the production cost and being apt to be widely applied in display devices.

However, the existing GOA driving circuit usually has a problem of insufficient charging, which may cause abnormal displaying of the display panel.

BRIEF SUMMARY OF THE INVENTION

The existing GOA driving circuit usually has a problem of insufficient charging, which may cause abnormal displaying of the display panel.

It is an object of embodiments of the present application to provide a method and a device for driving a display panel, which aims at solving the problem that the existing GOA driving circuit usually has insufficient charging, which may cause abnormal displaying of the display panel.

The present application provides a method for driving a display panel.

The display panel comprises: pixel display cells in array distribution, and pixel drive cells, configured to respectively drive the pixel display cells;

a liquid crystal polarity of liquid crystal molecules in an x-th row is the same as a liquid crystal polarity of liquid crystal molecules in an x+4m-th row, wherein x is an integer greater than or equal to 1, and m is an integer greater than or equal to 1.

The method comprises:

outputting an initial scanning signal, wherein the initial scanning signal comprises two pulse signals;

pre-charging an x-th row of pixel drive cells when the x-th row of pixel drive cells receive a first pulse signal; and charging the x-th row of pixel drive cells when the x-th row of pixel drive cells receive a second pulse signal, writing data into the x-th row of pixel drive cells, and meanwhile, pre-charging an x+4m-th row of pixel drive cells.

Optionally, the initial scanning signal is a start signal configured to display an image frame on the display panel.

Optionally, the initial scanning signal has a frequency of 50-60 Hz.

Optionally, the operation of pre-charging the x+4m-th row of pixel drive cells comprises:

pre-charging the x+4m-th row of pixel drive cells to a voltage level of the x-th row of pixel drive cells.

Optionally, the first pulse signal and the second pulse signal are separated by 4n clock cycles, and n is an integer greater than or equal to 1.

Optionally, the operation of pre-charging the x-th row of pixel drive cells when the x-th row of pixel drive cells receive the first pulse signal of the initial scanning signal particularly comprises:

charging the x-th row of pixel drive cells to a first preset voltage level when the x-th row of pixel drive cells receive the first pulse signal.

Optionally, the operation of charging the x-th row of pixel drive cells when the x-th row of pixel drive cells receive the second pulse signal of the initial scanning signal comprises:

charging the x-th row of pixel drive cells to a preset operating voltage level when the x-th row of pixel drive cells receive the second pulse signal of the initial scanning signal.

Optionally, the liquid crystal polarity of the liquid crystal molecules is inverted once every two rows, starting from the second row.

Optionally, the display panel comprises pixel display cells arranged in the array with 2160 rows.

Optionally, a respective pixel display cell is any one of a red pixel cell, a green pixel cell, and a blue pixel cell.

The present application further provides a device for driving a display panel. The display panel comprises: pixel display cells in array distribution, and pixel drive cells, configured to respectively drive the pixel display cells;

a liquid crystal polarity of liquid crystal molecules in an x-th row is the same as a liquid crystal polarity of liquid crystal molecules in an x+4m-th row, wherein x is an integer greater than or equal to 1, and m is an integer greater than or equal to 1.

The device comprises:

a timing controller, configured to output an initial scanning signal, wherein the initial scanning signal comprises two pulse signals;

a first charger, configured to pre-charge an x-th row of pixel drive cells when the x-th row of pixel drive cells receive a first pulse signal; and a second charger, configured to charge the x-th row of pixel drive cells when the x-th row of pixel drive cells receive a second pulse signal, write data into the x-th row of pixel drive cells, and meanwhile, pre-charge an x+4m-th row of pixel drive cells.

Optionally, the initial scanning signal is a start signal configured to display an image frame on the display panel.

Optionally, the initial scanning signal has a frequency of 50-60 Hz.

Optionally, the second charger is further configured to pre-charge the x+4m-th row of pixel drive cells to a voltage level of the x-th row of pixel drive cells.

Optionally, the first pulse signal and the second pulse signal are separated by 4n clock cycles, and n is an integer greater than or equal to 1.

Optionally, the first charger is further configured to charge the x-th row of pixel drive cells to a preset operating voltage level when the x-th row of pixel drive cells receive the second pulse signal of the initial scanning signal.

Optionally, the liquid crystal polarity of the liquid crystal molecules is inverted once every two rows, starting from the second row.

Optionally, a respective pixel display cell is any one of a red pixel cell, a green pixel cell, and a blue pixel cell.

The present application further provides a method for driving a display panel. The display panel comprises: pixel display cells in array distribution, and pixel drive cells, configured to respectively drive the pixel display cells;

a liquid crystal polarity of liquid crystal molecules in an x-th row is the same as a liquid crystal polarity of liquid crystal molecules in an x+4m-th row, the liquid crystal polarity of the liquid crystal molecules is inverted once every two rows, starting from the second row, wherein x is an integer greater than or equal to 1, and m is an integer greater than or equal to 1.

The method comprises:

outputting an initial scanning signal, wherein the initial scanning signal comprises two pulse signals;

charging the x-th row of pixel drive cells to a first preset voltage level when the x-th row of pixel drive cells receive a first pulse signal; and charging the x-th row of pixel drive cells when the x-th row of pixel drive cells receive a second pulse signal, writing data into the x-th row of pixel drive cells, and meanwhile, pre-charging the x+4m-th row of pixel drive cells to a voltage level of the x-th row of pixel drive cells.

Optionally, the first pulse signal and the second pulse signal are separated by 4n clock cycles, and n is an integer greater than or equal to 1.

In the method and the device for driving the display panel provided by embodiments of the present application. An initial scanning signal comprising two pulse signals is output; when the x-th row of pixel drive cells receive a first pulse signal, an x-th row of pixel drive cells is pre-charged; and when the x-th row of pixel drive cells receive a second pulse signal, the x-th row of pixel drive cells is charged, data are written into the x-th row of pixel drive cells, and meanwhile, an x+4m-th row of pixel drive cells are pre-charged. In this way, the charging time of the pixel drive cell of the display panel is improved, and it is solved the problem that the existing GOA driving circuit usually has insufficient charging, causing abnormal displaying of the display panel.

BRIEF DESCRIPTION OF THE DRAWINGS

In order to more clearly illustrate the technical solution in embodiments of the present application, the following drawings, which are to be used in the description of the embodiments or the existing techniques, will be briefly described. It will be apparent that the drawings described in the following description are merely embodiments of the present application. Other drawings may be obtained by those skilled in the art without paying creative labor.

DETAILED DESCRIPTION OF THE EMBODIMENTS

In order to make those skilled in the art better understood the technical solutions of the present application, technical solutions in embodiments of the present application are clearly described hereinbelow with reference to accompanying drawings in the embodiments of the present application. Obviously, the described embodiments are only a part of embodiments of the present application, rather than all the embodiments. All other embodiments obtained by those skilled in the art based on the embodiments of the present application without creative efforts shall fall within the protection scope of the present application.

Terms "comprising" and variations thereof in description, claims, and the drawings of the present application are intended to cover non-exclusive inclusion. For example, a process, a method, a system, a product, or a device that includes a series of steps or cells is not limited to the steps or the cells listed, but may optionally include steps or cells not listed, or may optionally include other inherent steps or cells for the process, the method, the product, or the device. In addition, terms "first", "second", "third", and the like are used to distinguish different objects, rather than to describe a particular order.

A display panel comprises: pixel display cells in array distribution, and pixel drive cells configured to respectively drive the pixel display cells. In the pixel display cells in the array distribution, starting from a second line, the polarity of liquid crystal molecules of the pixel display cells is inverted once every two rows, so that the liquid crystal polarity of the liquid crystal molecules in an x-th row is the same as the liquid crystal polarity of the liquid crystal molecules in an x+4m-th row, where x is an integer greater than or equal to 1, and m is an integer greater than or equal to 1.

Figure 1:
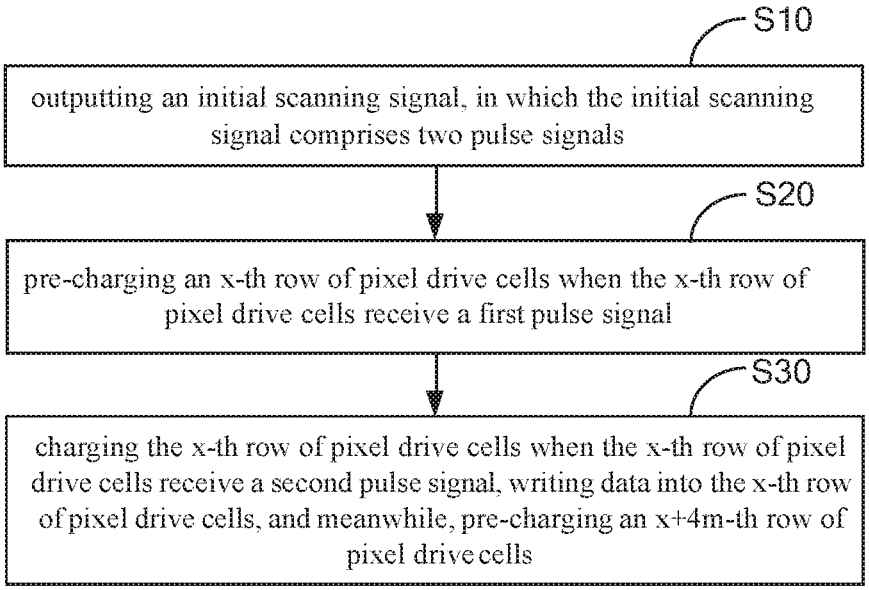
FIG. 1 is a schematic flow chart of a method for driving a display panel according to one embodiment of the present application.

FIG. 1 is a schematic flow chart of a method for driving a display panel provided by an embodiment of the present application.

As shown in FIG. 1, the method for driving the display panel of the present embodiment comprises:

Step S10: outputting an initial scanning signal, in which the initial scanning signal comprises two pulse signals;

Step S20: pre-charging an x-th row of pixel drive cells when the x-th row of pixel drive cells receive a first pulse signal; and Step S30: charging the x-th row of pixel drive cells when the x-th row of pixel drive cells receive a second pulse signal, writing data into the x-th row of pixel drive cells, and meanwhile, pre-charging an x+4m-th row of pixel drive cells.

Figure 2:
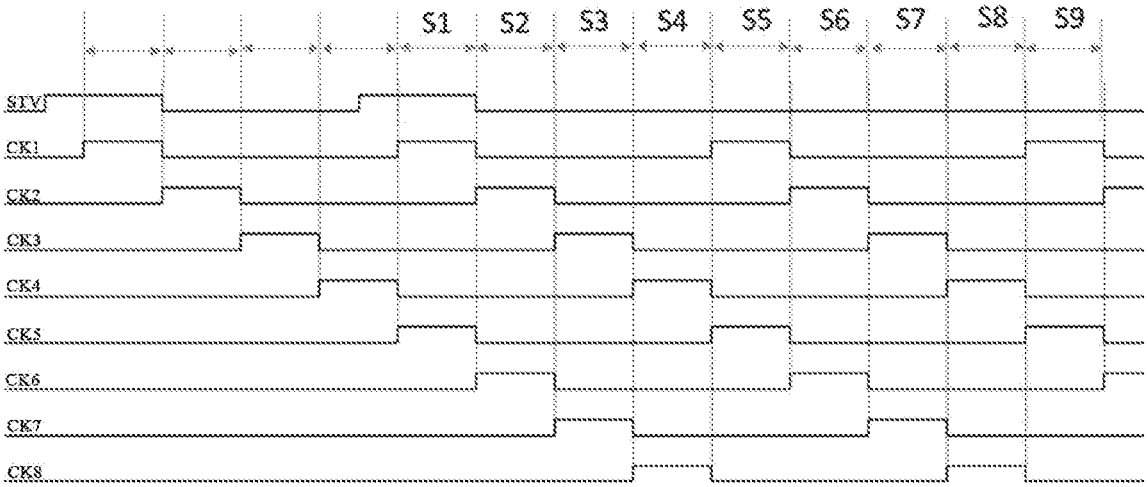
FIG. 2 is a timing chart of scan time of a GOA circuit to the pixel display cells in the case of 8 clock cycle signals in a method for driving a display panel provided by one embodiment of the present application.

In this embodiment, when driving the pixel drive cells of the display panel, the GOA circuit needs to receive an initial scanning signal (STV) and n clock cycle signals (CLK). For example, FIG. 2 shows scan time of the GOA circuit in the case of 8 clock cycle signals. As shown in FIG. 2, the initial scanning signal is switched on twice before rising edges of the cycle signal CK1 and the cycle signal CK5, thus, each gate line in the display panel is switched on for twice, the first time is to pre-charge the pixel drive cells at the starting of the rising edge of the cycle signal CK1, and the second time is to charge the pixel drive cells at the starting of the rising edge of the cycle signal CK5. When the charging of the pixel drive cells is completed, data signals are written into the pixel display cells, and the pixel display cells are driven by the pixel drive cells to display corresponding information according to the data signals.

In one embodiment, the respective pixel drive cell is a thin film transistor. In the liquid crystal display, each pixel is provided with a thin film transistor. A gate of the thin film transistor is in connection with a horizontal scan line, a drain of the thin film transistor is in connection with a vertical data line, and a source of the thin film transistor is in connection with a pixel electrode. When the voltage applied to the horizontal scan line reaches an operating voltage, all of the thin film transistors on the horizontal scan line are turned on, in this case, the pixel electrodes on the horizontal scan line are connected to the vertical data lines, such that display signals of the data lines are written into the pixels, and the transmittance of different liquid crystals is controlled to achieve the purpose of color control.

In one embodiment, the initial scanning signal is a start signal configured to display an image frame on the display panel. In the display panel, the display panel comprises a plurality of rows of pixel cells to form one image frame, and the whole image frame is formed by scanning the pixel cells row by row by the scan signal. The initial scanning signal is the start signal of one image frame and configured to scan the first row of pixel cells.

In one embodiment, the initial scanning signal has a frequency of 50-60 Hz.

In one embodiment, the operation of pre-charging the x+4m-th row of pixel drive cells comprises: pre-charging the x+4m-th row of pixel drive cells to a voltage level of the x-th row of pixel drive cells.

Particularly, the x+4m-th row of thin film transistors are pre-charged to reach a voltage level of gates of the x-th row of thin film transistors, which is lower than an operating voltage level of each thin film transistor.

In one embodiment, the first pulse signal and the second pulse signal are separated by 4n clock cycles, and n is an integer greater than or equal to 1.

In one embodiment, the operation of pre-charging the x-th row of pixel drive cells when the x-th row of pixel drive cells receive the first pulse signal of the initial scanning signal particularly comprises: charging the x-th row of pixel drive cells to a first preset voltage level when the x-th row of pixel drive cells receive the first pulse signal. The first preset voltage level is the charging voltage of the pixel drive cell during a precharge phase.

In one embodiment, the first preset voltage level can be set according to the need of the user.

In one embodiment, the operation of charging the x-th row of pixel drive cells when the x-th row of pixel drive cells receive the second pulse signal of the initial scanning signal comprises: charging the x-th row of pixel drive cells to a preset operating voltage level when the x-th row of pixel drive cells receive the second pulse signal of the initial scanning signal. Particularly, the preset operating voltage level is a voltage of the pixel drive cell for driving the corresponding pixel cell.

In the embodiment, when the x-th row of pixel drive cells receive the second pulse signal of the initial scanning signal, the voltage of the gates of the x-th row of thin film transistors reach the preset operating voltage level, in this case, the x-th row of thin film transistors are turned on, and the pixel electrodes on the horizontal scan line will be connected with the vertical data lines, so as to write the display signal voltage of the data line into the pixels, and control transmittance of different liquid crystals, thereby achieving the purpose of color control.

In the embodiment, the liquid crystal polarity of the liquid crystal molecules is inverted once every two rows, starting from the second row.

In one embodiment, the display panel comprises pixel display cells arranged in the array with 2160 rows.

In one embodiment, a respective pixel display cell is any one of a red pixel cell, a green pixel cell, and a blue pixel cell.

FIG. 2 is a timing chart of scan time of the GOA circuit to the pixel display cells in the case of 8 clock cycle signals in the method for driving the display panel provided by one embodiment of the present application.

As shown in FIG. 2, the initial scanning signal is switched on twice before rising edges of the cycle signal CK1 and the cycle signal CK5, thus, each gate line in the display panel is switched on for twice, the first time is to pre-charge the pixel drive cells at the starting of the rising edge of the cycle signal CK1, and the second time is to charge the pixel drive cells at the starting of the rising edge of the cycle signal CK5. When the charging of the pixel drive cells is completed, data signals are written into the pixel display cells, and the pixel display cells are driven by the pixel drive cells to display corresponding information according to the data signals.

Figure 3:
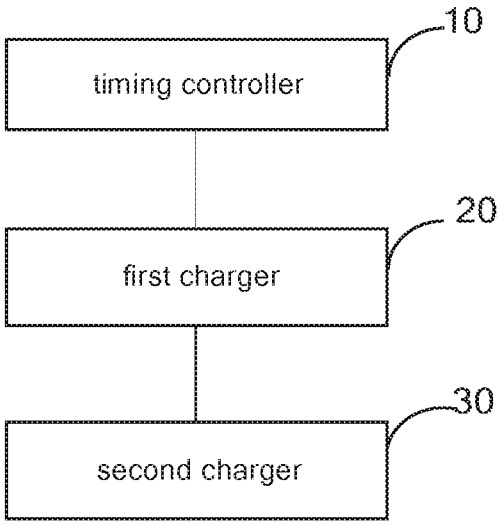
FIG. 3 is a schematic structural diagram of a structure of a device for driving a display panel according to an embodiment of the present application.

FIG. 3 is a schematic structural diagram of a structure of a device for driving a display panel according to an embodiment of the present application.

The device for driving the display panel is provided by the present embodiment, in which, the display panel comprises: pixel display cells in array distribution, and pixel drive cells, configured to respectively drive the pixel display cells;

a liquid crystal polarity of liquid crystal molecules in an x-th row is the same as a liquid crystal polarity of liquid crystal molecules in an x+4m-th row, where x is an integer greater than or equal to 1, and m is an integer greater than or equal to 1.

The device for driving the display panel comprises:

a timing controller 10, configured to output an initial scanning signal, in which, the initial scanning signal comprises two pulse signals;

a first charger 20, configured to pre-charge an x-th row of pixel drive cells when the x-th row of pixel drive cells receive a first pulse signal; and a second charger 30, configured to charge the x-th row of pixel drive cells when the x-th row of pixel drive cells receive a second pulse signal, write data into the x-th row of pixel drive cells, and meanwhile, pre-charge an x+4m-th row of pixel drive cells.

In one embodiment, the timing controller 10 is configured to output an initial scanning signal (STV) and n clock cycle signals (CLK). For example, as shown in FIG. 2, the initial scanning signal is switched on twice before rising edges of the cycle signal CK1 and the cycle signal CK5, thus, each gate line in the display panel is switched on for twice, the first time is to pre-charge the pixel drive cells at the starting of the rising edge of the cycle signal CK1, and the second time is to charge the pixel drive cells at the starting of the rising edge of the cycle signal CK5. When the charging of the pixel drive cells is completed, data signals are written into the pixel display cells, and the pixel display cells are driven by the pixel drive cells to display corresponding information according to the data signals.

In one embodiment, the initial scanning signal is a start signal configured to display an image frame on the display panel.

In one embodiment, the initial scanning signal has a frequency of 50-60 Hz.

In one embodiment, the second charger 30 is further configured to pre-charge the x+4m-th row of pixel drive cells to a voltage level of the x-th row of pixel drive cells.

In one embodiment, the first pulse signal and the second pulse signal are separated by 4n clock cycles, and n is an integer greater than or equal to 1.

In one embodiment, the first charger 20 is further configured to charge the x-th row of pixel drive cells to a preset operating voltage level when the x-th row of pixel drive cells receive the second pulse signal of the initial scanning signal.

In the embodiment, when the x-th row of pixel drive cells receive the second pulse signal of the initial scanning signal, the voltage of the gates of the x-th row of thin film transistors reach the preset operating voltage level, in this case, the x-th row of thin film transistors are turned on, and the pixel electrodes on the horizontal scan line will be connected with the vertical data lines, so as to write the display signal voltage of the data line into the pixels, and control transmittance of different liquid crystals, thereby achieving the purpose of color control.

In the embodiment, the liquid crystal polarity of the liquid crystal molecules is inverted once every two rows, starting from the second row.

In one embodiment, a respective pixel display cell is any one of a red pixel cell, a green pixel cell, and a blue pixel cell.

Figure 4:
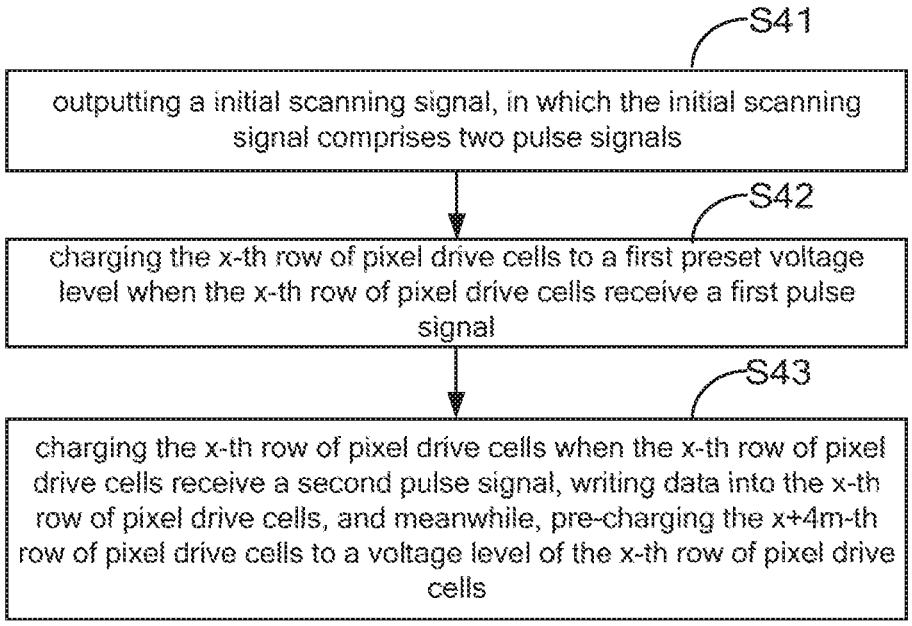
FIG. 4 is a schematic diagram of a method for driving a display panel according to another embodiment of the present application.

FIG. 4 is a schematic diagram of a method for driving a display panel according to another embodiment of the present application.

In this embodiment, the display panel comprises: pixel display cells in array distribution, and pixel drive cells, configured to respectively drive the pixel display cells;

a liquid crystal polarity of liquid crystal molecules in an x-th row is the same as a liquid crystal polarity of liquid crystal molecules in an x+4m-th row, where x is an integer greater than or equal to 1, and m is an integer greater than or equal to 1.

As shown in FIG. 4, the method for driving the display panel of the present embodiment comprises:

Step S41: outputting an initial scanning signal, in which the initial scanning signal comprises two pulse signals;

Step S42: charging the x-th row of pixel drive cells to a first preset voltage level when the x-th row of pixel drive cells receive a first pulse signal; and Step S43: charging the x-th row of pixel drive cells when the x-th row of pixel drive cells receive a second pulse signal, writing data into the x-th row of pixel drive cells, and meanwhile, pre-charging the x+4m-th row of pixel drive cells to a voltage level of the x-th row of pixel drive cells.

In one embodiment, when driving the pixel drive cells of the display panel, the GOA circuit needs to receive an initial scanning signal (STV) and n clock cycle signals (CLK). For example, FIG. 2 shows scan time of the GOA circuit in the case of 8 clock cycle signals. As shown in FIG. 2, the initial scanning signal is switched on twice before rising edges of the cycle signal CK1 and the cycle signal CK5, thus, each gate line in the display panel is switched on for twice, the first time is to pre-charge the pixel drive cells at the starting of the rising edge of the cycle signal CK1, and the second time is to charge the pixel drive cells at the starting of the rising edge of the cycle signal CK5. When the charging of the pixel drive cells is completed, data signals are written into the pixel display cells, and the pixel display cells are driven by the pixel drive cells to display corresponding information according to the data signals.

In one embodiment, the respective pixel drive cell is a thin film transistor. In the liquid crystal display, each pixel is provided with a thin film transistor. A gate of the thin film transistor is in connection with a horizontal scan line, a drain of the thin film transistor is in connection with a vertical data line, and a source of the thin film transistor is in connection with a pixel electrode. When the voltage applied to the horizontal scan line reaches an operating voltage, all of the thin film transistors on the horizontal scan line are turned on, in this case, the pixel electrodes on the horizontal scan line are connected to the vertical data lines, such that display signals of the data lines are written into the pixels, and the transmittance of different liquid crystals is controlled to achieve the purpose of color control.

In one embodiment, the first pulse signal and the second pulse signal are separated by 4n clock cycles, and n is an integer greater than or equal to 1.

The cells in the devices of the embodiments of the present application may be combined, divided, or deleted according to actual needs.

The steps in the methods of the embodiments of the present application may be adjusted in their sequences, merged, or deleted according to actual needs.

Those skilled in the art can understand that all or a part of the process of implementing the methods in the above embodiments can be completed by instructing related hardware by a computer program, and the program can be stored in a computer readable storage medium. In execution of the program, operations of the methods in the above embodiments can be included. The storage medium may be a magnetic disk, an optical disk, a read-only memory (ROM), or a random access memory (RAM).

The above description is only the optional embodiments of the present application, and is not intended to limit the present application. Any modifications, equivalent substitutions, and improvements made within the spirit and principles of the present application are included in the protection scope of the present application.

What is claimed is:

1. A method for driving a display panel, the display panel comprising: pixel display cells in array distribution, and pixel drive cells, configured to respectively drive the pixel display cells; wherein a liquid crystal polarity of liquid crystal molecules in an x-th row is the same as a liquid crystal polarity of liquid crystal molecules in an x+4m-th row, wherein x is an integer greater than or equal to 1, and m is an integer greater than or equal to 1; and wherein the method comprises: outputting an initial scanning signal, wherein the initial scanning signal comprises two pulse signals; pre-charging an x-th row of pixel drive cells when the x-th row of pixel drive cells receive a first pulse signal; and charging the x-th row of pixel drive cells when the x-th row of pixel drive cells receive a second pulse signal, writing data into the x-th row of pixel drive cells, and meanwhile, pre-charging an x+4m-th row of pixel drive cells, and wherein the first pulse signal and the second pulse signal are separated by 4n clock cycles, and n is an integer greater than or equal to 1.

2. The method of claim 1, wherein the operation of pre-charging the x+4m-th row of pixel drive cells comprises: pre-charging the x+4m-th row of pixel drive cells to a voltage level of the x-th row of pixel drive cells.

3. The method of claim 1, wherein the operation of pre-charging the x-th row of pixel drive cells when the x-th row of pixel drive cells receive the first pulse signal of the initial scanning signal particularly comprises: charging the x-th row of pixel drive cells to a first preset voltage level when the x-th row of pixel drive cells receive the first pulse signal.

4. The method of claim 1, wherein the operation of charging the x-th row of pixel drive cells when the x-th row of pixel drive cells receive the second pulse signal of the initial scanning signal comprises: charging the x-th row of pixel drive cells to a preset operating voltage level when the x-th row of pixel drive cells receive the second pulse signal of the initial scanning signal.

5. The method of claim 1, wherein the display panel comprises pixel display cells arranged in the array with 2160 rows.

6. The method of claim 1, wherein the initial scanning signal is a start signal configured to display an image frame on the display panel.

7. The method of claim 6, wherein the initial scanning signal has a frequency of 50-60 Hz.

8. The method of claim 1, wherein the liquid crystal polarity of the liquid crystal molecules is inverted once every two rows, starting from the second row.

9. The method of claim 8, wherein a respective pixel display cell is any one of a red pixel cell, a green pixel cell, and a blue pixel cell.

10. A device for driving a display panel, the display panel comprising:

pixel display cells in array distribution, and pixel drive cells, configured to respectively drive the pixel display cells; wherein a liquid crystal polarity of liquid crystal molecules in an x-th row is the same as a liquid crystal polarity of liquid crystal molecules in an x+4m-th row, wherein x is an integer greater than or equal to 1, and m is an integer greater than or equal to 1; and wherein the device comprises:

a processor, and a memory storing one or more programs including instructions that, when executed by the processor, cause the device to:

output an initial scanning signal, wherein the initial scanning signal comprises two pulse signals;

pre-charge an x-th row of pixel drive cells when the x-th row of pixel drive cells receive a first pulse signal; and charge the x-th row of pixel drive cells when the x-th row of pixel drive cells receive a second pulse signal, writing data into the x-th row of pixel drive cells, and meanwhile, pre-charging an x+4m-th row of pixel drive cells, and wherein the first pulse signal and the second pulse signal are separated by 4n clock cycles, and n is an integer greater than or equal to 1.

11. The device of claim 10, wherein execution of the instructions causes the device to further: pre-charge the x+4m-th row of pixel drive cells to a voltage level of the x-th row of pixel drive cells.

12. The device of claim 10, wherein execution of the instructions causes the device to further: charge the x-th row of pixel drive cells to a preset operating voltage level when the x-th row of pixel drive cells receive the second pulse signal of the initial scanning signal.

13. The device of claim 10, wherein the liquid crystal polarity of the liquid crystal molecules is inverted once every two rows, starting from the second row.

14. The device of claim 10, wherein a respective pixel display cell is any one of a red pixel cell, a green pixel cell, and a blue pixel cell.

15. The device of claim 10, wherein the initial scanning signal is a start signal configured to display an image frame on the display panel.

16. The device of claim 15, wherein the initial scanning signal has a frequency of 50-60 Hz.

17. A method for driving a display panel, the display panel comprising: pixel display cells in array distribution, and pixel drive cells, configured to respectively drive the pixel display cells; wherein a liquid crystal polarity of liquid crystal molecules in an x-th row is the same as a liquid crystal polarity of liquid crystal molecules in an x+4m-th row, the liquid crystal polarity of the liquid crystal molecules is inverted once every two rows, starting from the second row, wherein x is an integer greater than or equal to 1, and m is an integer greater than or equal to 1; and wherein the method comprises: outputting an initial scanning signal, wherein the initial scanning signal comprises two pulse signals; charging the x-th row of pixel drive cells to a first preset voltage level when the x-th row of pixel drive cells receive a first pulse signal; and charging the x-th row of pixel drive cells when the x-th row of pixel drive cells receive a second pulse signal, writing data into the x-th row of pixel drive cells, and meanwhile, pre-charging the x+4m-th row of pixel drive cells to a voltage level of the x-th row of pixel drive cells, and wherein the first pulse signal and the second pulse signal are separated by 4n clock cycles, and n is an integer greater than or equal to 1.

* * * * *